US008766068B2

(12) United States Patent
Frirsz et al.

(10) Patent No.: US 8,766,068 B2
(45) Date of Patent: Jul. 1, 2014

(54) INTERCHANGEABLE TUNERS FOR A TAILPIECE OF A MUSICAL INSTRUMENT

(76) Inventors: Nicholas Frirsz, Greenfield Ctr, NY (US); Robert A. Penicka, Saratoga Springs, NY (US)

( * ) Notice: Subject to any disclaimer, the term of this patent is extended or adjusted under 35 U.S.C. 154(b) by 371 days.

(21) Appl. No.: 13/104,147

(22) Filed: May 10, 2011

(65) Prior Publication Data

US 2012/0285311 A1 Nov. 15, 2012

(51) Int. Cl.
*G10D 3/12* (2006.01)

(52) U.S. Cl.
USPC ..... 84/297 R

(58) Field of Classification Search
USPC ..... 84/297 R
See application file for complete search history.

(56) References Cited

U.S. PATENT DOCUMENTS

| | | | | | |
|---|---|---|---|---|---|
| 2,234,218 | A | * | 3/1941 | Abrams | 84/312 R |
| 2,877,678 | A | * | 3/1959 | Infeld | 84/302 |
| 2,969,703 | A | * | 1/1961 | Matteo | 84/299 |
| 3,096,676 | A | * | 7/1963 | Havivi et al. | 84/302 |
| 4,224,857 | A | * | 9/1980 | Infeld | 84/302 |
| 4,672,877 | A | * | 6/1987 | Hoshino et al. | 84/299 |
| 6,175,066 | B1 | | 1/2001 | McCabe | |
| 7,304,225 | B2 | | 12/2007 | Ricci | |

* cited by examiner

*Primary Examiner* — Christopher Uhlir
(74) *Attorney, Agent, or Firm* — Darrell L. Pogue; Keohane & D'Alessandro, PLLC

(57) ABSTRACT

In general, the present invention provides a tailpiece for a musical instrument. Among other things, the tailpiece includes a plurality of openings for receiving a plurality of strings and a detachable tuner positioned within one or more of the plurality of openings. Among other features, the tailpiece includes a set of detachable keyhole inserts positioned within one or more of the openings of the tailpiece unoccupied by a detachable tuner. Each detachable tuner is interchangeable with one of the detachable keyhole string inserts, thus allowing players to use tuners with any string desired for complete customization based on each player's preference.

11 Claims, 5 Drawing Sheets

INTERCHANGEABLE TUNERS FOR A TAILPIECE OF A MUSICAL INSTRUMENT

CROSS REFERENCE TO RELATED APPLICATION

The present application is related in some aspects to commonly owned and co-pending application entitled "TAILPIECE FOR A MUSICAL INSTRUMENT," U.S. patent application Ser. No. 12/405,338, filed on Mar. 17, 2009, the entire contents of which are herein incorporated by reference.

FIELD OF THE INVENTION

The present invention generally relates to a tailpiece of a musical instrument. Specifically, the present invention relates to a tailpiece having attachable/detachable fine tuners to increase player customization.

BACKGROUND OF THE INVENTION

Stringed instruments are well known throughout the musical world. As is generally know, a stringed instrument will typically include, among other parts, a body, neck, bridge, and a set of strings. In instruments such as violins, violas, cellos, etc., a tailpiece can also be included. The tailpiece is attached to the body and receives the strings, thus, holding the strings in a linear and tightened position. The traditional mechanism available to a player for adjusting the pitch of the strings involves turning the pegs of the instrument. Typically, a first end of each of four strings of the instrument is attached to (i.e., wound around) one of the four pegs in a pegbox. Each of the second ends of the four strings is inserted through and retained in a corresponding opening in the tailpiece. The pitch of a string, which is determined primarily by its tension and length, can be changed by turning the peg to which it is attached.

Players can also adjust the pitch of a string using a fine tuner attached to the second end of the string at its corresponding hole in the tailpiece. Typically, the end of the string to be fine-tuned is looped around a hook on the fine tuner, such that the turn of a thumbscrew on the fine tuner changes the length of the string and, therefore, its pitch. Most modern players use fine tuners because it makes tuning their instruments much easier and requires less time. Some players like them only on the higher pitch strings because those strings tend to go out of tune more often. However, current approaches fail to provide easy interchangeability/customization desired by many players.

SUMMARY OF THE INVENTION

In general, the present invention provides a tailpiece for a musical instrument. Among other things, the tailpiece includes a plurality of openings for receiving a plurality of strings and a detachable tuner positioned within one or more of the plurality of openings. Among other features, the tailpiece includes a set of detachable keyhole inserts positioned within one or more of the openings of the tailpiece unoccupied by a detachable tuner. Each detachable tuner is interchangeable with one of the detachable keyhole string inserts, thus allowing players to use tuners with any string desired for complete customization based on each player's preference.

A first aspect of the present invention provides a tailpiece for a musical instrument, comprising: a plurality of openings in the tailpiece for receiving a plurality of strings; and a detachable tuner positioned within one or more of the openings such that an outside perimeter surface of the detachable tuner abuts an inner surface of the tailpiece formed by the at least one of the plurality of openings.

A second aspect of the present invention provides a tuning apparatus for use with a tailpiece of a musical instrument, comprising: a set of detachable tuners each comprising: an opening for receiving an instrument string; a tuner arm having a channel at a first end for containing the instrument string, the tuner arm having a second end engaged with a tuning screw; and an outside perimeter surface in abutment with an inner surface of the tailpiece formed by the at least one of a plurality of openings in the tailpiece. The apparatus further comprises a set of detachable keyhole string inserts positioned within openings in the tailpiece unoccupied by the set of detachable tuners.

A third aspect of the present invention provides a tailpiece for a musical instrument, comprising: a plurality of openings in the tailpiece for receiving a plurality of strings; a set of detachable tuners positioned within one or more of the plurality of openings such that an outside perimeter surface of the detachable tuner abuts an inner surface of the tailpiece formed by at least one of the plurality of openings; and a set of detachable keyhole string inserts positioned within openings in the tailpiece unoccupied by the set of detachable tuners.

BRIEF DESCRIPTION OF THE DRAWINGS

These and other features of this invention will be more readily understood from the following detailed description of the various aspects of the invention taken in conjunction with the accompanying drawings in which.

Figure 1A:
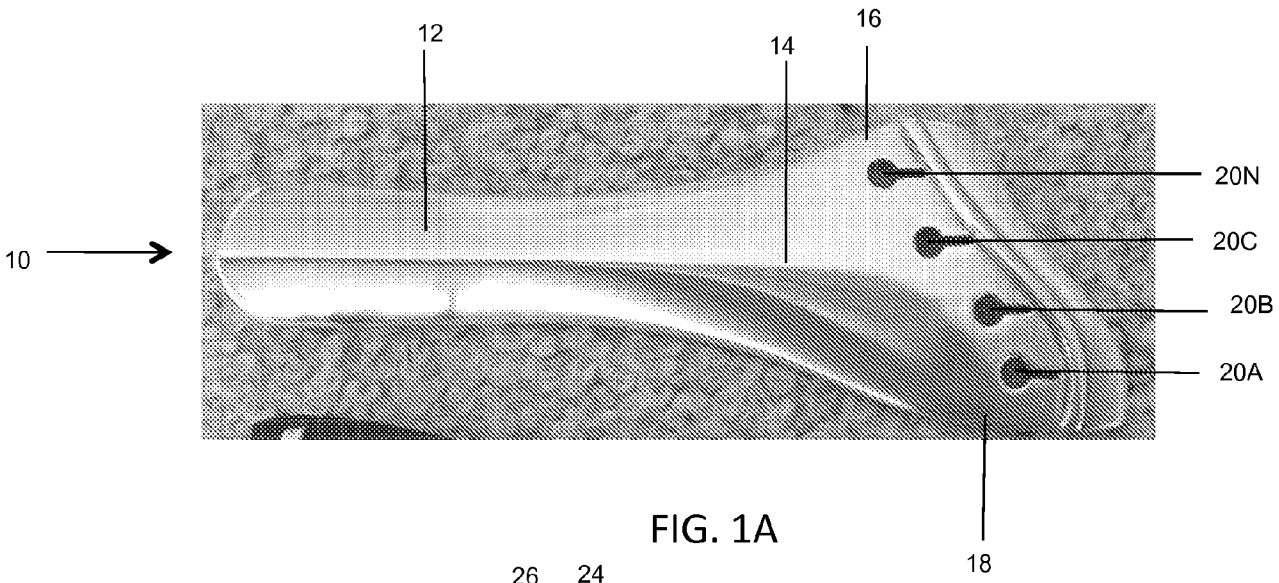
FIG. 1A depicts a top surface of a tailpiece according to one embodiment of the present invention.

The drawings are not necessarily to scale. The drawings are merely schematic representations, not intended to portray specific parameters of the invention. The drawings are intended to depict only typical embodiments of the invention, and therefore should not be considered as limiting the scope of the invention. In the drawings, like numbering represents like elements.

DESCRIPTION OF THE INVENTION

Exemplary embodiments now will be described more fully herein with reference to the accompanying drawings, in which exemplary embodiments are shown. This disclosure may, however, be embodied in many different forms and should not be construed as limited to the exemplary embodiments set forth herein. Rather, these exemplary embodiments are provided so that this disclosure will be thorough and complete and will fully convey the scope of this disclosure to those skilled in the art. In the description, details of well-known features and techniques may be omitted to avoid unnecessarily obscuring the presented embodiments.

The terminology used herein is for the purpose of describing particular embodiments only and is not intended to be limiting of this disclosure. As used herein, the singular forms "a", "an", and "the" are intended to include the plural forms as well, unless the context clearly indicates otherwise. Furthermore, the use of the terms "a", "an", etc., do not denote a limitation of quantity, but rather denote the presence of at least one of the referenced items. It will be further understood that the terms "comprises" and/or "comprising", or "includes" and/or "including", when used in this specification, specify the presence of stated features, regions, integers, steps, operations, elements, and/or components, but do not preclude the presence or addition of one or more other features, regions, integers, steps, operations, elements, components, and/or groups thereof.

As indicated above, the present invention provides a tailpiece for a musical instrument. Among other things, the tailpiece includes a plurality of openings for receiving a plurality of strings and a detachable tuner positioned within one or more of the plurality of openings. Among other features, the tailpiece includes a set of detachable keyhole inserts positioned within one or more of the openings of the tailpiece unoccupied by a detachable tuner. Each detachable tuner is interchangeable with one of the detachable keyhole string inserts, thus allowing players to use tuners with any string desired for complete customization based on each player's preference.

Figure 1B:
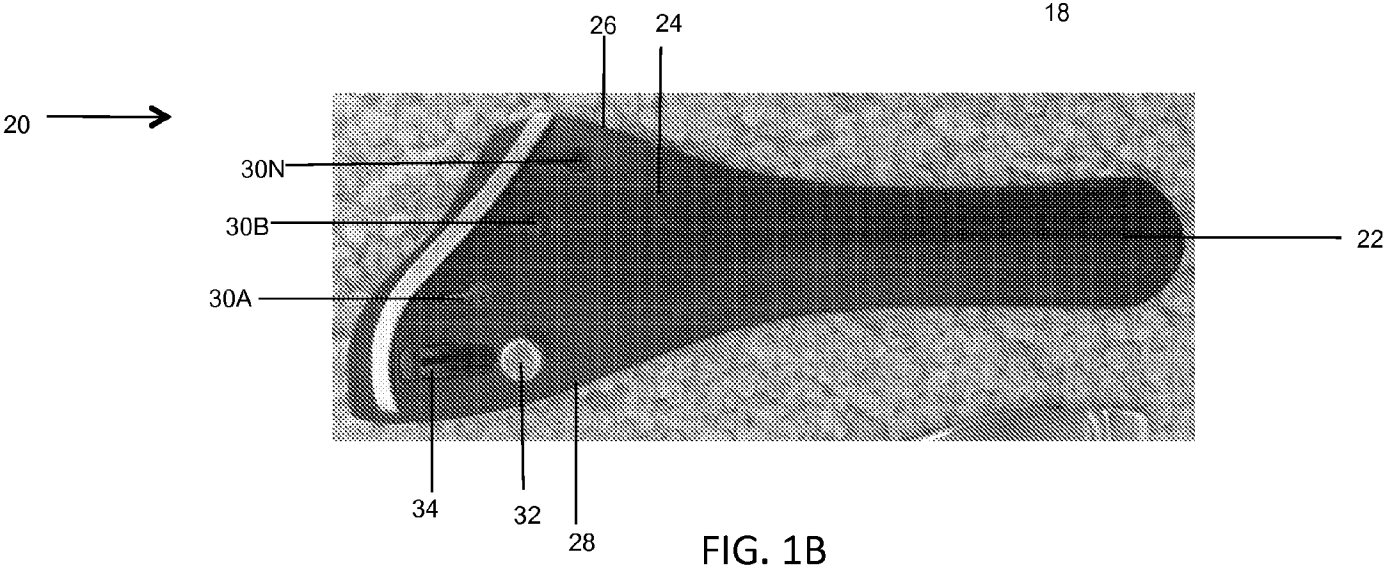
FIG. 1B depicts a top surface of a tailpiece according to another embodiment of the present invention.

Referring now to FIG. 1A, a top surface of a tailpiece 10 according to the present invention is shown. As depicted, tailpiece 10 includes a tail end 12, a head 14, a bass side 16, a treble side 18, and a plurality of string holes 20A-N for receiving a plurality of strings (shown in FIG. 3). FIG. 1B shows a top surface of another tailpiece according to the present invention. Similarly, tailpiece 20 includes a tail end 22, a head 24, a bass side 26, a treble side 28, and a plurality of string holes 30A-N for receiving a plurality of strings. Tailpiece 20 also includes tuning screw 32 and tuner 34.

Figure 2:
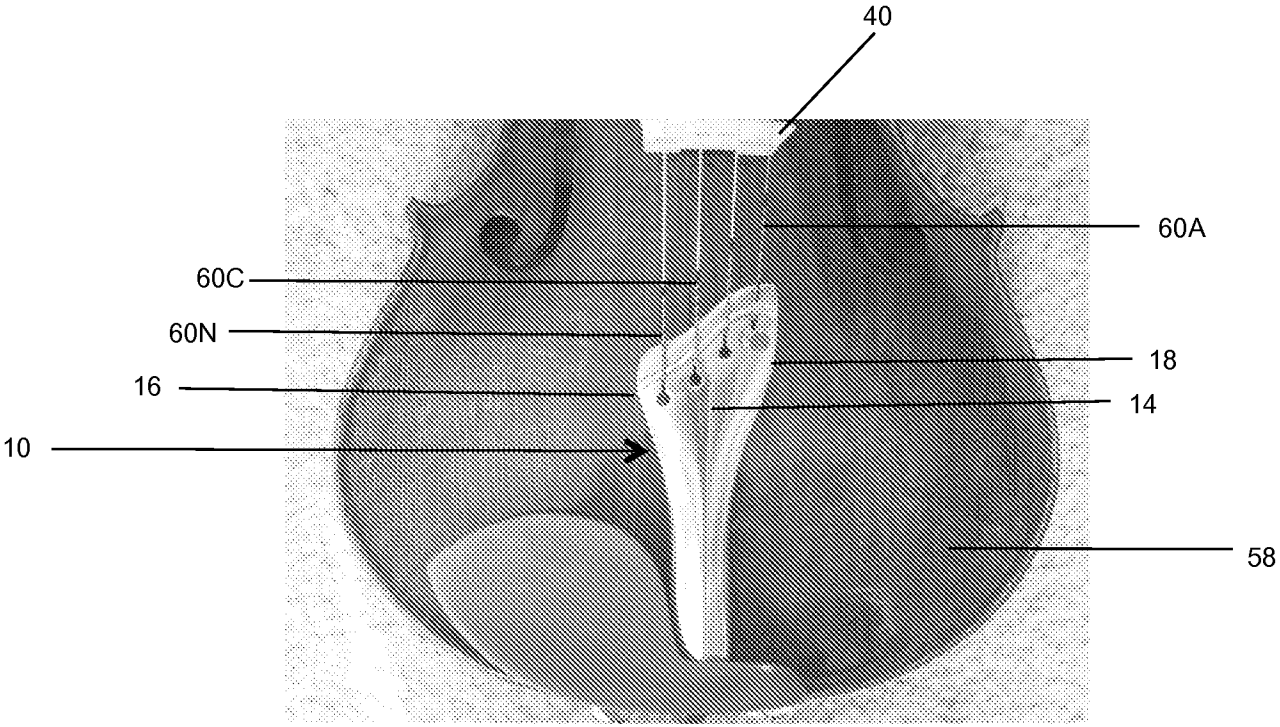
FIG. 2 depicts the tailpiece of the present invention on a musical instrument.

FIG. 2 depicts tailpiece 10 attached to a musical instrument 58. As shown, string holes 20A-N (FIG. 1A) receive strings 60A-N. In this embodiment, tailpiece 10 is designed so that the open string length below a bridge 40 is progressively longer for each lower pitch string (e.g., 60N). This feature provides more string area for the longer wavelength bass tones to resonate from the bass strings. In this configuration tailpiece 10 balances the instrument by adding clarity and strength to the bass tones to match the typically stronger projection and clarity produced from the treble strings (e.g., 60A). The lengthening of the bass strings greatly reduced wolf tones (i.e., a dissonant sound that is often accompanied by an audible pulse) by changing the harmonics of the instrument. The sympathetic vibrations are still present, and very much needed to get the most projection and tonal richness from the instrument, but the unpleasant harmonics are reduced. Furthermore, tailpiece 10 has a built in twist due to its 'S' shaped head 14 in the tip area where the strings 60A-60N attach. This configuration positions the bass strings (e.g., 60N and 60C) lower than the treble strings, which redistributes the down force on bridge 40. This significantly increases the efficiency of bridge 40 and enhances the overall volume and projection of instrument 58.

Figure 3:
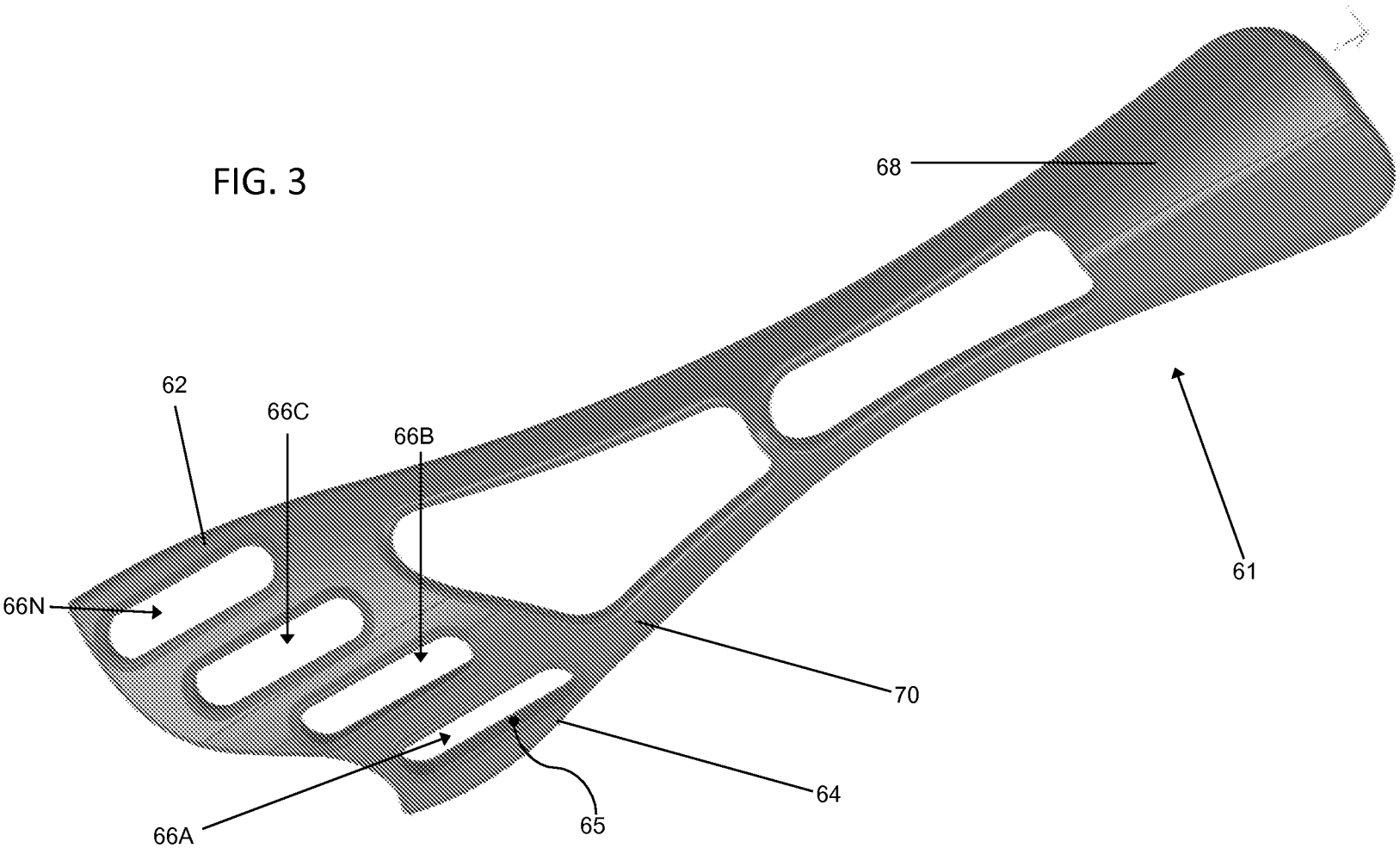
FIG. 3 depicts a perspective view of a tailpiece of the present invention with a plurality of openings according an embodiment of the invention.

Referring now to FIG. 3, a tailpiece 61 according to an embodiment of the invention will be described in greater detail. As shown, tailpiece 61 comprises a treble side 62, a bass side 64 opposite treble side 62, and a plurality of openings 66A-N for receiving a set of detachable tuners and/or a set of detachable keyhole string attachments, as will be further discuss below. Openings 66A-N receive a plurality of strings (not shown) during operation. Tailpiece 61 includes a tail end 68 and a head 70.

Figure 4A:
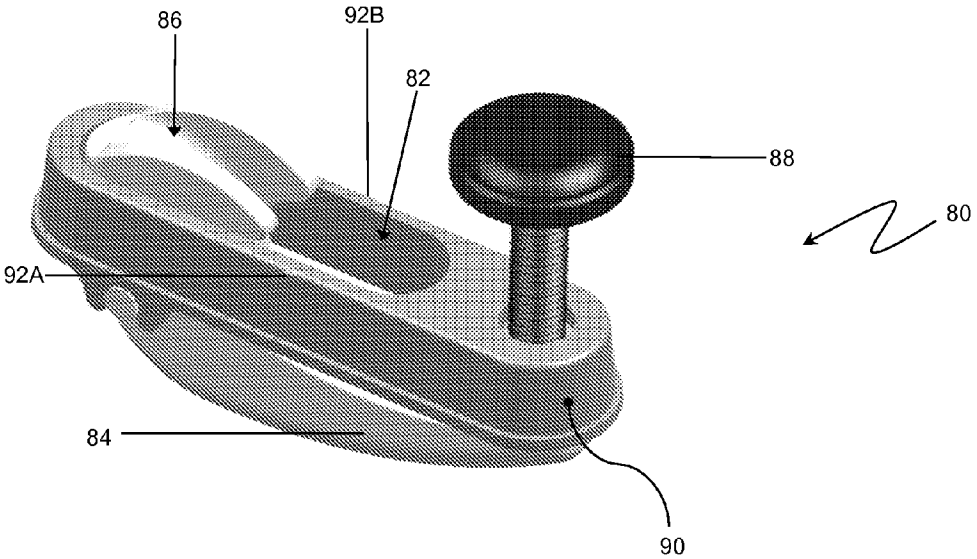
FIG. 4A depicts a perspective view of a detachable tuner according to an embodiment of present invention.
Figure 4B:
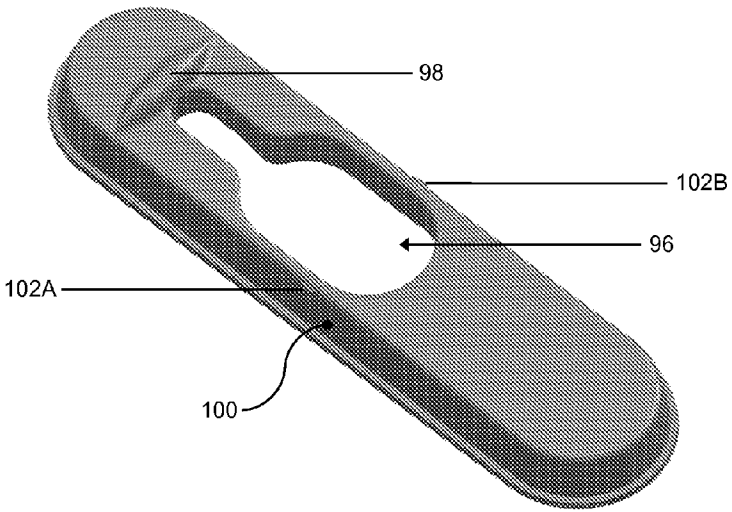
FIG. 4B depicts a perspective view of a detachable keyhole string insert according to an embodiment of invention.

Tailpiece 61 is configured to operate with a detachable tuner 80 and a detachable keyhole string attachment 95 depicted in FIGS. 4A and 4B, respectively. As shown, detachable tuner 80 (i.e., a fine tuner) comprises an opening 82 for receiving an instrument string (not shown), and a tuner arm 84 having a channel 86 at a first end for containing the instrument string. Tuner arm 84 operates with a tuning screw 88 at a second end for controlling the fine-tuning of the instrument strings by the player. During operation, detachable tuner 80 is attachable/detachable with tailpiece 61 and is situated within one or more openings 66A-N shown in FIG. 3. That is, an outside perimeter surface 90 of detachable tuner 80 is in abutment with an inner surface 65 of tailpiece 61 formed by at least one of the plurality of openings 66A-N in tailpiece 61 (FIG. 3). In one embodiment, outside perimeter 90 of detachable tuner 80 further comprises a set of fasteners 92A, 92B for coupling detachable tuner 80 to tailpiece 61. However, it will be appreciated that fasteners 92A, 92B are shown for exemplary purposes only, and that many alternative configurations for securing the detachable tuners to the tailpiece are possible within the scope of the invention.

FIG. 4B depicts detachable keyhole string insert 95 according to an embodiment of the invention. As shown, detachable keyhole string insert 95 comprises an opening 96 for receiving the instrument string, and a lip 98, which prevents the instrument string from resting flat against the front face of detachable keyhole string insert 95. During operation, detachable keyhole string insert 95 is attachable/detachable with tailpiece 61 and is situated within one or more openings 66A-N shown in FIG. 3. That is, similar to tuner 80, an outside perimeter surface 100 of detachable keyhole string insert 95 is in abutment with inner surface 65 of tailpiece 61 formed by at least one of the plurality of openings 66A-N in tailpiece 61 (FIG. 3). In an embodiment, outside perimeter 100 of each detachable keyhole string insert 95 includes a set of fasteners 102A, 102B for coupling detachable keyhole string insert 95 to tailpiece 61.

Figure 5A:
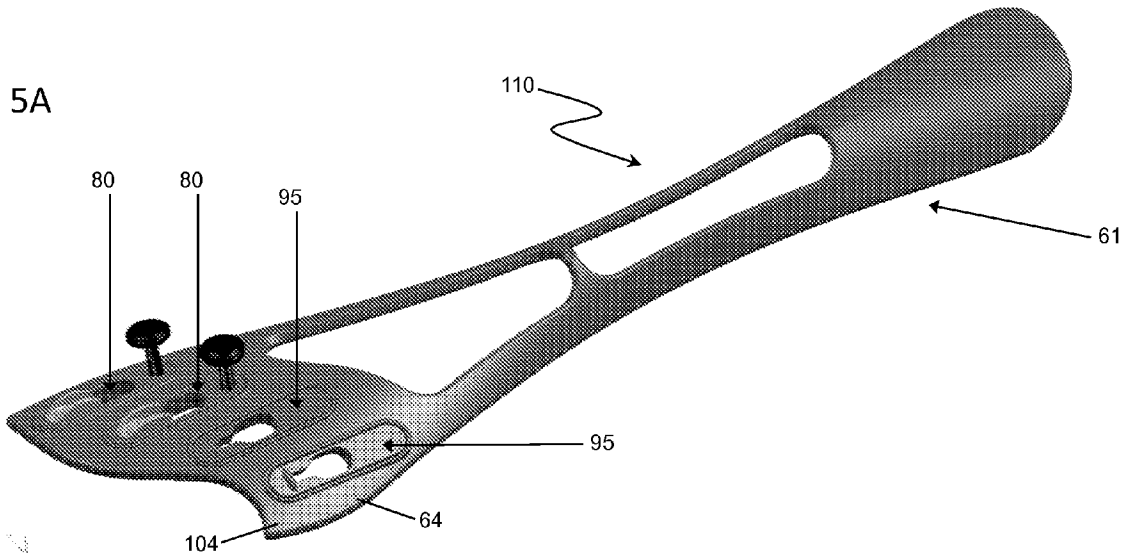
FIG. 5A depicts a perspective view of an apparatus including a set of detachable tuners and a set of detachable keyhole string inserts positioned within openings of the tailpiece according to an embodiment of the invention.
Figure 5B:
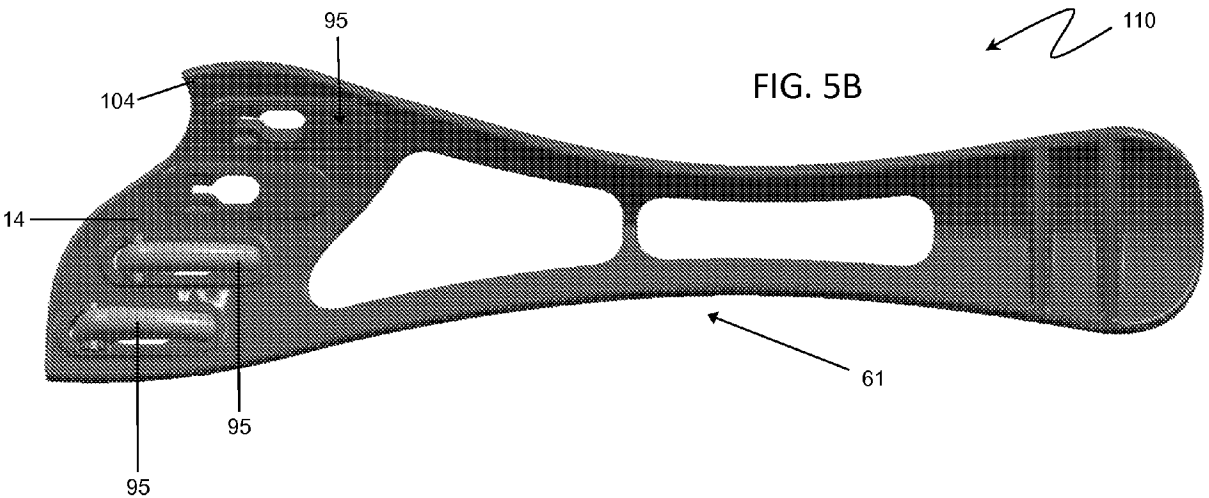
FIG. 5B depicts a bottom view of the apparatus of FIG. 5A according to an embodiment of the invention.

The basic structure/geometry of detachable tuner 80 and detachable keyhole string insert 95 allows each component to be easily interchanged for one another, as shown in FIGS. 5A-5B. Apparatus 110 comprises tailpiece 61 having a set of detachable tuners 80 and a set of detachable keyhole string inserts 95 positioned within openings 66A-N (FIG. 3). As designed, each of the detachable tuners 80 is interchangeable with each of the detachable keyhole string inserts 95. This allows increased customization by a player. For example, based on preference, players may wish to use detachable tuners 80 on some or all of the strings. If a player wishes to position tuners on less than all of the strings, detachable keyhole inserts 95 are used within any the openings unoccupied by detachable tuners 80. The detachable tuners may be swapped with detachable keyhole string inserts, thus allowing players to use tuners with any string desired for complete customization based on each player's preference.

Furthermore, as discussed above, tailpiece 61 has a built in twist due to its 'S' shaped head 14 in the area where the strings 60A-60N attach. That is, a tip portion 104 near treble side 64 of head 14 curves down towards musical instrument 58 (FIG. 2) to position the bass strings (e.g., 60N and 60C) lower than the treble strings (e.g., 60A-B). This redistributes the down force on bridge 40, which significantly increases the efficiency of bridge 40 and enhances the overall volume and projection of instrument 58.

The foregoing description of various aspects of the invention has been presented for purposes of illustration and description. It is not intended to be exhaustive or to limit the invention to the precise form disclosed, and obviously, many modifications and variations are possible. Such modifications and variations that may be apparent to a person skilled in the art are intended to be included within the scope of the invention as defined by the accompanying claims.

What is claimed is:

1. A tailpiece for a musical instrument, comprising:

a plurality of openings in the tailpiece for receiving a plurality of strings;

a detachable tuner positioned within one or more of the plurality of openings such that an outside perimeter surface of the detachable tuner abuts an inner surface of the tailpiece within the one or more of the plurality of openings; and a set of detachable keyhole string inserts positioned within one or more of the plurality of openings, wherein the detachable tuner is interchangeable with each of the set of detachable keyhole string inserts.

2. The tailpiece of claim 1, the detachable tuner further comprising:

an opening for receiving an instrument string; and a tuner arm having a channel at a first end for containing the instrument string, the tuner arm being engaged with a tuning screw at a second end.

3. The tailpiece of claim 1, further comprising a plurality of detachable tuners.

4. The tailpiece of claim 1, further comprising:

a head comprising:

a treble side;

a bass side opposite the treble side; and a curved tip portion proximate the bass side, the curved tip portion extending towards a top surface of the musical instrument.

5. A tuning apparatus for use with a tailpiece of a musical instrument, the tuning apparatus comprising:

a set of detachable tuners each comprising:

an opening for receiving an instrument string;

a tuner arm having a channel at a first end for containing the instrument string, the tuner arm having a second end engaged with a tuning screw; and an outside perimeter surface in abutment with an inner surface of the tailpiece within at least one of a plurality of openings in the tailpiece; and a set of detachable keyhole string inserts positioned within one or more openings in the tailpiece unoccupied by the set of detachable tuners, wherein each of the set of detachable tuners may be replaced with one of the set of detachable keyhole string inserts.

6. The tuning apparatus of claim 5, the outside perimeter surface of each of the set of detachable tuners further comprising a set of fasteners for coupling each of the set of detachable tuners to the tailpiece.

7. The tuning apparatus of claim 5, each of the set of detachable keyhole string inserts comprising an outside perimeter surface in abutment with the openings in the tailpiece unoccupied by the set of detachable tuners.

8. A tailpiece for a musical instrument, comprising:

a plurality of openings in the tailpiece for receiving a plurality of strings;

a set of detachable tuners positioned within one or more of the plurality of openings such that an outside perimeter surface of the detachable tuner abuts an inner surface of the tailpiece within the one or more of the plurality of openings; and a set of detachable keyhole string inserts positioned within one or more openings in the tailpiece unoccupied by the set of detachable tuners, wherein each of the set of detachable tuners is interchangeable with each of the set of detachable keyhole string inserts.

9. The tailpiece of claim 8, each of the set of detachable keyhole string inserts comprising an outside perimeter surface in abutment with the one or more openings in the tailpiece unoccupied by the set of detachable tuners.

10. The tailpiece of claim 8, each of the set of detachable tuners further comprising:

an opening for receiving an instrument string; and a tuner arm having a channel at a first end for containing the instrument string, the tuning arm being engaged with a tuning screw at a second end.

11. The tailpiece of claim 8, further comprising:

a head comprising:

a treble side;

a bass side opposite the treble side; and a curved tip portion proximate the bass side, the curved tip portion extending towards a top surface of the musical instrument.

* * * * *